US006484824B2

(12) United States Patent
Skyles

(10) Patent No.: US 6,484,824 B2
(45) Date of Patent: Nov. 26, 2002

(54) FAILURE INDICATOR FOR ROLLING CUTTER DRILL BIT

(75) Inventor: Lane P. Skyles, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1 day.

(21) Appl. No.: 09/682,165

(22) Filed: Jul. 30, 2001

(65) Prior Publication Data

US 2002/0023783 A1 Feb. 28, 2002

Related U.S. Application Data

(60) Provisional application No. 60/227,336, filed on Aug. 23, 2000.

(51) Int. Cl.[7] ..... E21B 10/50; E21B 10/16

(52) U.S. Cl. ..... 175/341; 175/378; 175/39; 175/331

(58) Field of Search ..... 175/39, 331, 341, 175/378, 426, 371, 327, 428

(56) References Cited

U.S. PATENT DOCUMENTS

| | | | | |
|---|---|---|---|---|
| 3,011,566 A | | 12/1961 | Graham | |
| 3,058,532 A | | 10/1962 | Alder | |
| 3,062,302 A | | 11/1962 | Toth et al. | |
| 3,363,702 A | | 1/1968 | Bielstein | |
| 3,678,883 A | | 7/1972 | Fischer | |
| 3,853,184 A | | 12/1974 | McCullough | |
| 3,952,815 A | | 4/1976 | Dysart | |
| 4,346,591 A | | 8/1982 | Evans | |
| 4,436,164 A | | 3/1984 | Garner | |
| 4,548,280 A | | 10/1985 | Daly et al. | |
| 4,655,300 A | | 4/1987 | Davis, Jr. et al. | |
| 4,716,977 A | | 1/1988 | Huffstutler | |
| 4,785,894 A | | 11/1988 | Davis, Jr. et al. | |
| 4,785,895 A | | 11/1988 | Davis, Jr. et al. | |
| 4,940,099 A | | 7/1990 | Deane et al. | |
| 4,984,643 A | * | 1/1991 | Isbell et al. | 175/341 |
| 5,183,123 A | | 2/1993 | White | |
| 5,348,770 A | * | 9/1994 | Sievers et al. | 175/374 |
| 5,372,210 A | | 12/1994 | Harrell | |
| 5,415,243 A | | 5/1995 | Lyon et al. | |
| 5,421,423 A | | 6/1995 | Huffstutler | |
| 5,671,817 A | | 9/1997 | Smith et al. | |
| 5,722,497 A | | 3/1998 | Gum et al. | |
| 5,890,550 A | | 4/1999 | Swadi et al. | |
| 6,374,930 B1 | * | 4/2002 | Singh et al. | 175/374 |
| 2002/0017401 A1 | * | 2/2002 | Xiang et al. | 175/331 |

* cited by examiner

*Primary Examiner*—David Bagnell
*Assistant Examiner*—Daniel P Stephenson
(74) *Attorney, Agent, or Firm*—Jeffery E. Daly

(57) ABSTRACT

A bearing failure indicator for sealed and lubricated rolling cutter earth boring drill bits is disclosed. A plurality of cutting inserts, arranged in a plurality of rows, are secured in the rolling cone cutters. At least two of the rolling cone cutters are intermeshing cutters, arranged such that they have intermeshing rows of cutting inserts. A groove is formed in the intermeshing cutters with a row containing a plurality of generally flat top bearing inserts. In the normal operation of the drill bit, the rows of generally flat top bearing inserts do not contribute to the drilling action of the drill bit. However, when a bearing assembly fails in operation, the generally flat top bearing inserts engage the intermeshing rows of inserts in the adjacent intermeshing cutter causing the drilling torque to increase and thereby providing a signal indicating the bearing has failed.

16 Claims, 3 Drawing Sheets

FAILURE INDICATOR FOR ROLLING CUTTER DRILL BIT

CROSS REFERENCE TO RELATED APPLICATIONS

This application claims priority from U.S. Provisional Patent Application No. 60/227,336 filed Aug. 23, 2000.

BACKGROUND OF INVENTION

1. Field of the Invention

The invention relates generally to rolling cutter earth boring drill bits used for the exploration and retrieval of petroleum and other minerals from the earth. In particular, the invention is a new form of bearing failure indicator for a rolling cutter earth boring drill bit.

2. Description of the Related Art

It is commonplace during drilling into the Earth for minerals such as oil and natural gas to drill boreholes thousands of feet deep. A rolling cutter drill bit used to drill these wells is so remote from the surface that even high quality instrumentation located near the bit while drilling is not able to accurately indicate the impending failure of the bearing in the drill bit. Oftentimes the drill bit fails suddenly and causes the drilling operation to be halted while the "junk" left behind by the failed bit is removed from the bottom of the borehole. The time lost in recovering this junk may cost the drilling company many thousands of dollars, and unless all the junk left by the failed bit is recovered, the replacement drill bit may also fail prematurely from damage by the junk.

Detecting impending bit failure is particularly difficult with rolling cutter type drill bits that utilize sealed and lubricated friction bearing systems. The reason for this is that when these bits first experience bearing failure, only relatively minor changes in drilling torque and drilling rate of penetration occur. Since these changes are usually within the range of normal torque and ROP variations, the bearing failure is usually not detected at the surface.

Often, the only indication of failure is the sudden decrease in drilling rate of penetration that occurs when bearing failure is total and junk is left in the hole. Although instrumentation packages built into measuring while drilling tools may at times be able to accurately detect impending bit failure, they are not able to detect it reliably. Furthermore, these MWD packages often add considerable expense to the drilling operation, and are therefore used sparingly. Consequently, it is highly desirable that any bearing failure mechanism be made into the drill bit.

Bearing failure indicator schemes are disclosed in numerous different rolling cutter drill bit designs, including U.S. Pat. Nos. 3,058,532, 3,011,566, 3,062,302, 3,363,702, 3,678,883, 3,853,184, 4,346,591, 4,436,164, 4,548,280, 4,655,300, 4,785,894, 4,785,895 and 5,183,123, all incorporated by reference herein for all they disclose. The complexity of these designs, and/or their tendency to falsely indicate a bearing failure have limited their utility. In fact, these designs have had only limited commercial success.

SUMMARY OF INVENTION

A new type of bearing failure indicator for sealed and lubricated rolling cutter drill bits is disclosed. The rolling cutter drill bit comprises a bit body adapted for rotation about a longitudinal axis, a plurality of extending legs, and a cantilevered bearing spindle formed on each leg. A plurality of rolling cone cutters are rotatably mounted upon the bearing spindles with the cone apices adjacent to the longitudinal axis of the bit. A plurality of cutting inserts are secured in the rolling cone cutters, and arranged in a plurality of rows. At least two of the rolling cone cutters are intermeshing cutters, arranged such that they have intermeshing rows of cutting inserts. At least one of the intermeshing cutters has at least two rows of cutting inserts arranged as two inner rows. A groove is formed intermediate the two inner rows. Within the groove is a row containing a plurality of generally flat top bearing inserts.

In the normal operation of the drill bit, the rows of generally flat top bearing inserts do not contribute to the drilling action of the drill bit. However, when a bearing assembly fails in operation, the generally flat top bearing inserts engage the intermeshing rows of inserts in the adjacent intermeshing cutter.

This engagement causes a sudden, relatively large increase in the drilling torque of the drill bit. This torque increase is readily discernable at the drill rig by the drilling crew, providing a reliable indication of a failed bearing. The disclosed arrangement provides an extremely reliable means of indicating a failed bearing in a rolling cutter drill bit.

DETAILED DESCRIPTION

Figure 1:
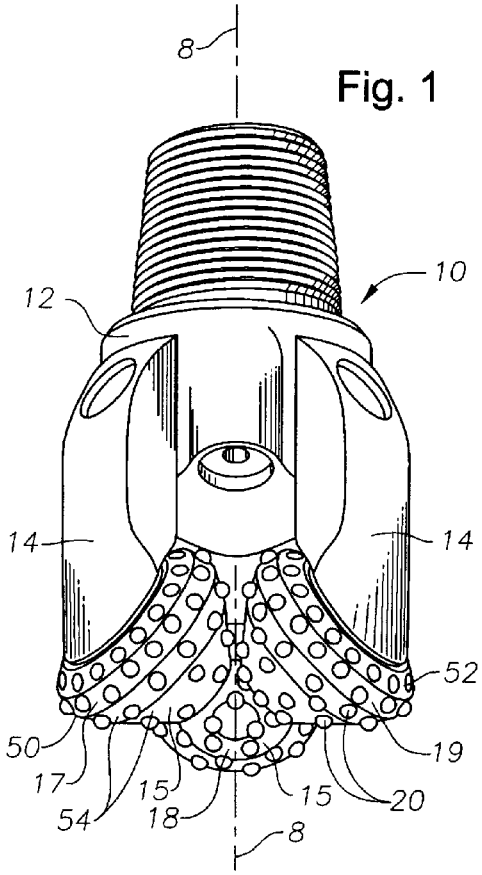
FIG. 1 is a perspective view of a rolling cutter drill bit of the present invention.
Figure 2:
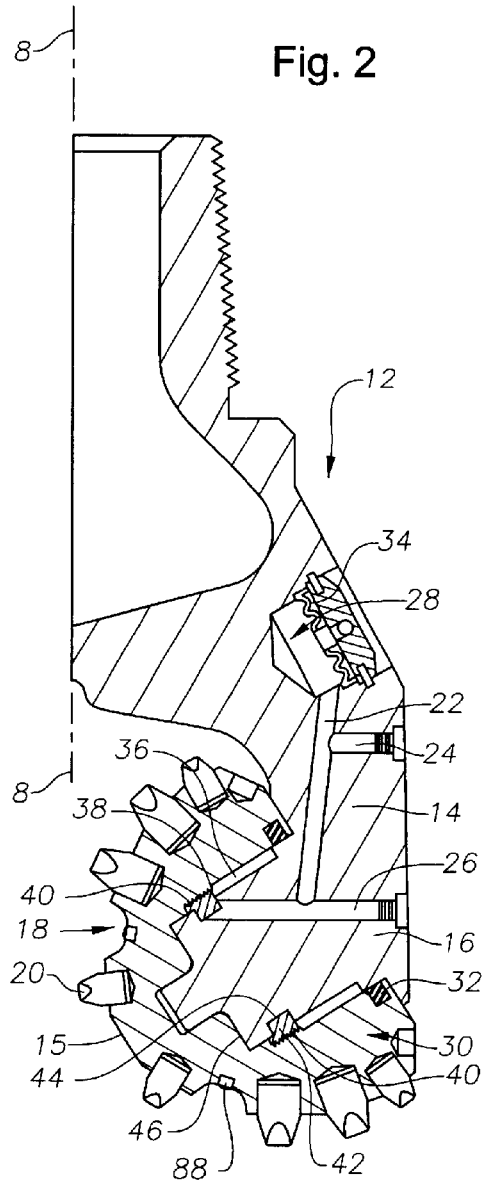
FIG. 2 is a cross section view of a rolling cutter mounted on one of the legs of a rolling cutter drill bit of the present invention.

Referring now to the drawings in more detail, and particularly to FIGS. 1 and 2, a rolling cutter earth boring drill bit 10 includes a body member 12 adapted for rotation about a longitudinal axis 8. A plurality of extending legs 14 depend from the bit body 10. Formed on each leg 14 is a cantilevered bearing spindle 16 which extends inwardly, toward the longitudinal axis 8 of the drill bit 10. Rotatably mounted on each bearing spindle 16 are rolling cone cutters 17, 18, and 19. The rolling cone cutters 17, 18, and 19 have cone apices 15 oriented so they are adjacent to the longitudinal axis 8 of the bit. Secured to a typical rolling cone cutter 18 are cutting inserts 20, which in operation engage the earth while the bit 10 is rotated about its longitudinal axis 8. The rotation of the drill bit 10 causes rotation of the rolling cone cutters 17, 18, 19 as they engage the earth to effect a drilling action.

Internal passageways 22, 24, and 26, as well as a reservoir 28 and bearing area 30 of the leg 14, are filled with lubricant (not shown) during bit assembly. The lubricant helps reduce bearing friction and wear during bit operation and is retained within the cutter 18 by a seal assembly 32. Pressure differentials between the lubricant and the external environment of the drill bit 10 are equalized by the movement of a pressure balancing diaphragm 34.

A sliding bearing member 36 is mounted between the spindle 16 and a mating bearing cavity 38 formed in the cutter 18. This bearing 36 is designed to carry the radial loads imposed upon the cutter 18 during drilling. A second bearing member 42 is configured as a split threaded ring which engages internal threads 40 in the bearing cavity 38 of the cutter and a groove 44 formed in the bearing spindle 16. This second bearing member 42 serves to retain the cutter 18 upon the bearing spindle 16 by resisting the forces which tend to push the cutter 18 inward, toward the longitudinal axis 8 of the bit, during drilling. A thrust bearing member 46 is disposed between the bearing spindle 16 and the cutter 18. This bearing member 46 carries the onward thrust forces imposed upon the cutter 18 during drilling.

Although the particular configuration of the rolling cone cutter 18 on the leg 14 shown in FIGS. 1 and 2 is typical for many rolling cutter drill bits, many other variants are possible without departing from the scope and spirit of the present invention. For example the second bearing member 42 may comprise a plurality of steel ball bearings. The sliding bearing member 36 could be the direct contact of the rolling cone cutter 18 on the bearing spindle 16. The seal assembly 32 could be a rigid face seal, an elastomer coated elastic sealing element, or any other suitable seal design. Finally, numerous configurations for the lubricant system may be possible, including the absence of the lubricant system including the internal passageways 22, 24, and 26, and the reservoir 28, as well as the seal assembly 32. The particular configuration shown and described is provided only to aid in the understanding of the present invention.

The cutting inserts 20 are fitted into sockets formed into the surfaces of the cutters 17, 18, 19. Cutting inserts 20 will preferably be formed of a hard, wear resistant material such as cemented tungsten carbide or other ceramics adapted to cut an earthen formation. Cutting inserts 20 may also be formed or coated with other materials including superhard materials such as polycrystalline diamond, CBN and diamond like carbon.

Figure 3A:
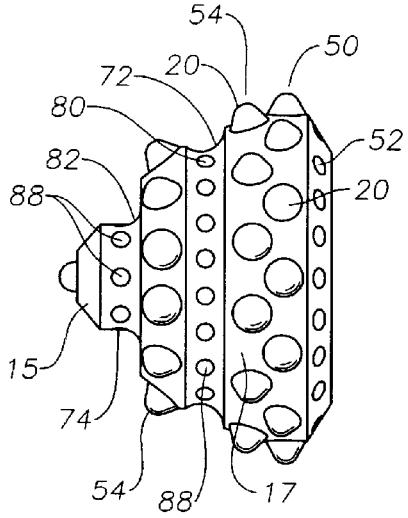
FIG. 3A is a perspective view of one of the rolling cutters of a rolling cutter drill bit of the present invention.
Figure 3B:
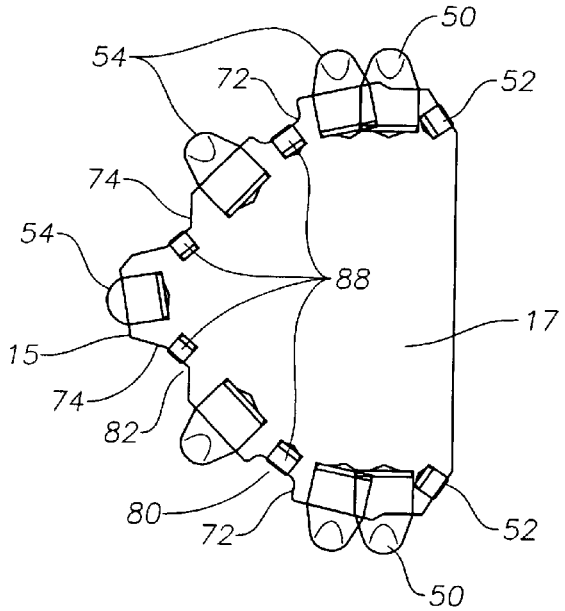
FIG. 3B is a partial cross section view of one of the cutters of a rolling cutter drill bit of the present invention showing the mounting and orientation of the cutting inserts.
Figure 4:
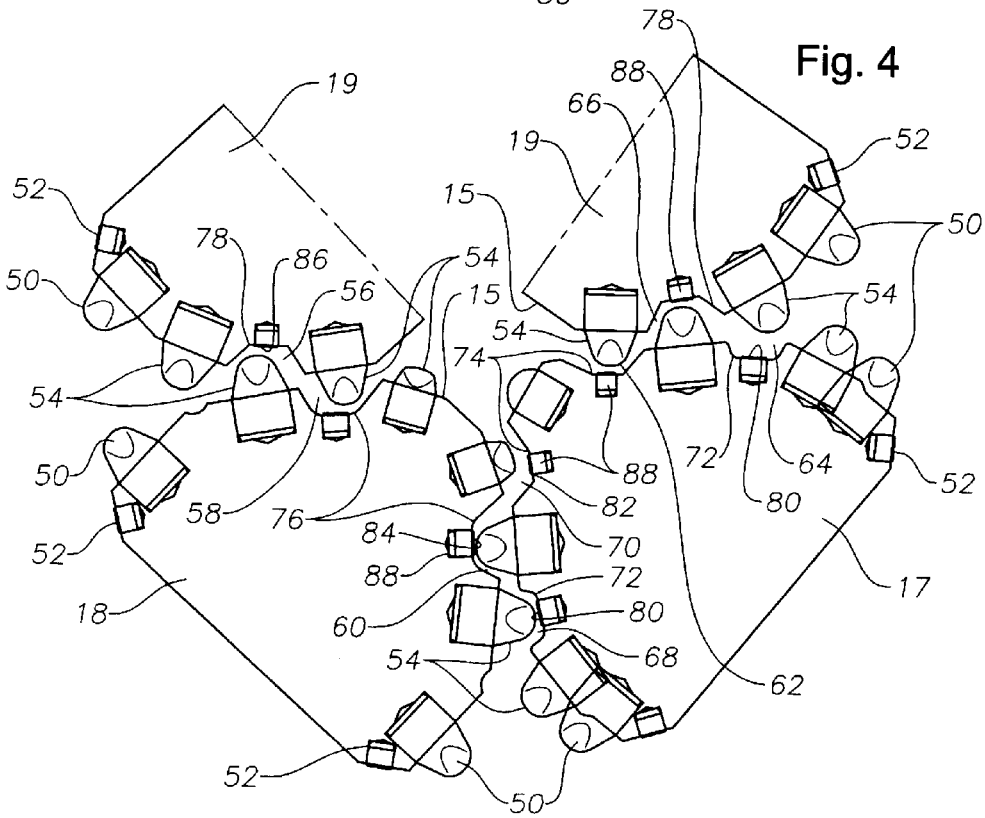
FIG. 4 is a layout view of the three rolling cutters showing the operating arrangement and intermeshing of the cutting inserts.

Referring now to FIGS. 3A, 3B, and 4, typically the cutting inserts 20 of each cutter 17, 18, 19 are arranged in a plurality of rows. The gauge rows 50 of the cutters 17, 18, and 19 cut the outer wall, or gauge, of the borehole made by drill bit 10 during operation. The gauge reaming rows 52 ream the borehole to full diameter if the gauge rows 50 experience wear. The inner rows 54 cut the bottom of the borehole.

Shown in FIG. 4 is a layout of cutters 17, 18, and 19 commonly used and well known by those skilled in the rolling cutter drill bit industry. The layout shows how the rows 50, 52, 54 of inserts 20 are arranged on the cutters 17, 18, and 19. The inner rows 54 of adjacent cutters generally intermesh as shown in the areas 56, 58, 60, 62, 64, 66, 68, and 70 of the assembled cutters 17, 18, 19. These areas 56, 58, 60, 62, 64, 66, 68, and 70 are formed by grooves 72 and 74 on cutter 17, groove 76 on cutter 18, and groove 78 on cutter 19 which register with the inner row 54 inserts 20 of cutters 17, 18, 19 so that they mutually intermesh.

The grooves 72, 74, 76, and 78 generally alternate with the inner rows 54 of inserts 20 on cutters 17, 18, 19. Accordingly, each groove 72, 74, 76, and 78 on respective cutters 17, 18, and 19 is located between adjacent inner rows 54 of inserts 20. One or more rows 80, 82, 84, 86 of generally flat top bearing inserts 88 are positioned in respective grooves 72, 74, 76, and 78.

Figure 5:
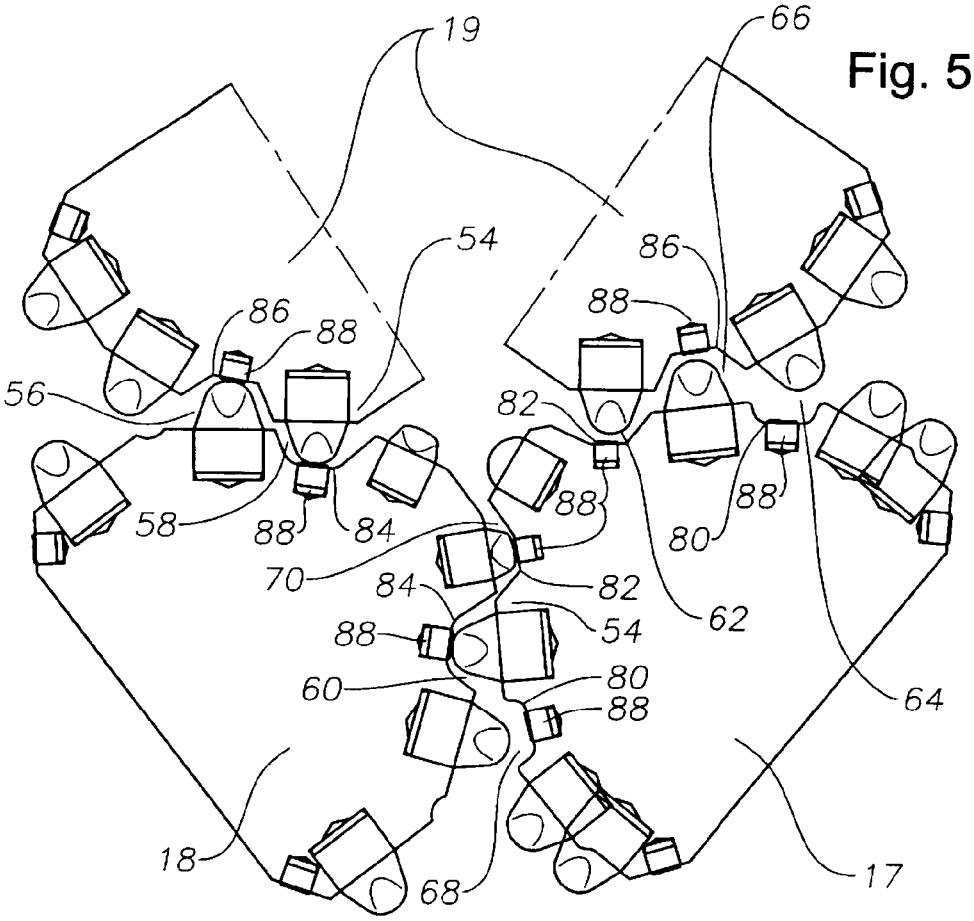
FIG. 5 is a layout view of the three rolling cutters showing the arrangement and intermeshing of the cutting inserts after one of the bearings has failed.

In the normal operation of the drill bit 10, the rows 80, 82, 84, 86 of generally flat top bearing inserts 88 do not contribute to the drilling action of the drill bit 10. However, when a bearing assembly fails in operation, as shown by cutter 18 in FIG. 5, the generally flat top bearing inserts 88 in the rows 80, 82, 84 engage the intermeshing inner rows 54 of inserts 20 in the adjacent intermeshing cutter. This is indicated by the contact in intermesh areas 58, and 60 on row 84 of cutter 18 in FIG. 5 with inner rows 54 of cutters 17 and 19. Contact is also made between the inner rows 54 of cutter 18 with row 82 of cutter 17 in intermesh area 70 and with row 86 of cutter 19 in intermesh area 56.

This engagement causes a sudden, relatively large increase in the drilling torque of the drill bit. This torque increase is readily discernable at the drill rig by the drilling crew, providing a reliable indication of a failed bearing.

Similar to cutting inserts 20, the generally flat top bearing inserts 88 may be formed of cemented tungsten carbide or coated with other materials including superhard materials such as polycrystalline diamond, cubic boron nitride (CBN) and diamond like carbon. However, it is preferred that the generally flat top bearing inserts 88 be formed of a material that is at least as hard, and preferably harder than that of the inserts 20 in the intermeshing inner rows.

The generally flat top bearing inserts 88 may have top edges that are curved slightly to conform with the surface radius of its groove. In addition, it may be desirable to provide the generally flat top bearing inserts 88 with a slightly domed region at the center of its top. These slight curvatures are provided so that when the inserts 20 engage the generally flat top bearing inserts 88, there is little or no contact between the tops of inserts and the steel surface of the cutters 17, 18, and 19.

It has been found that this relatively simple arrangement of generally flat top bearing inserts 88 in the grooves 72, 74, 76, and 78 provides a reliable means of indicating a failed bearing in a rolling cutter drill bit 10. During operation, if one bearing fails, the driller has the option to continue drilling for a short distance if necessary. If a second bearing on the bit 10 fails, a second additional increase in drilling torque will normally occur. Even though the bearings have failed, the driller will have the opportunity to retrieve the bit 10 before one or more of the cutters 17, 18, 19 wear so much that they come off of the bit body.

Whereas the present invention has been described in particular relation to the drawings attached hereto, it should be understood that other and further modifications apart from those shown or suggested herein, may be made within the scope and spirit of the present invention.

I claim:

1. A rolling cutter drill bit comprising a bit body adapted for rotation about a longitudinal axis, a plurality of extending legs, and a cantilevered bearing spindle formed on each leg, a plurality of rolling cone cutters being rotatably mounted upon the bearing spindles, a plurality of cutting inserts being secured in the rolling cone cutters, and being arranged in a plurality of rows, at least two of the rolling cone cutters being intermeshing cutters, arranged such that they have intermeshing rows of cutting inserts, wherein at least one of the intermeshing cutters has a groove arranged to register with one of the rows of cutting inserts of another of the intermeshing cutters, and wherein the groove contains a plurality of generally flat top bearing inserts.

2. The drill bit of claim 1, wherein at least one of the intermeshing cutters has at least two rows of cutting inserts arranged as two inner rows defining therebetween the groove.

3. The drill bit of claim 1, wherein three rolling cone cutters are provided, each one intermeshing with the others through one or more of the rows of cutting inserts and each including said groove containing the plurality of the generally flat top bearing inserts.

4. The drill bit of claim 3, wherein one of the rolling cone cutters has two grooves and the remaining rolling cone cutters have one groove.

5.The drill bit of claim 1, wherein the positioning of the generally flat top bearing inserts is such that, in normal use, they do not contact the cutting inserts, such contact occurring in the event of a failure on the bearing spindle.

6. The drill bit of claim 5, wherein such contact results in a significant increase in drilling torque.

7. The drill bit of claim 1, wherein the generally flat top bearing inserts have an exposed edge or edges curved to conform, generally, with the shape of the groove.

8. The drill bit of claim 1, wherein at least one of the generally flat top bearing inserts is provided with a domed central region.

9. The drill bit of claim 1, wherein at least one of the generally flat top bearing insert is at least as hard as the cutting inserts.

10. The drill bit of claim 9, wherein the generally flat top bearing inserts is of cemented tungsten carbide form.

11. The drill bit of claim 10, wherein at least one of the generally flat top bearing inserts is provided with a wear resistant coating.

12. The drill bit of claim 9, wherein at least one of the generally flat top bearing insert is provided with a wear resistant coating.

13.The drill bit of claim 12, wherein the wear resistant coating is of a superhard material.

14.The drill bit of claim 13, wherein the superhard material comprises polycrystalline diamond.

15. The drill bit of claim 13, wherein the superhard material comprises cubic boron nitride (CBN).

16. The drill bit of claim 13, wherein the superhard material comprises diamond-like carbon.

* * * * *